US011476034B2

(12) United States Patent
Jo et al.

(10) Patent No.: US 11,476,034 B2
(45) Date of Patent: Oct. 18, 2022

(54) COIL ELECTRONIC COMPONENT

(71) Applicant: SAMSUNG ELECTRO-MECHANICS CO., LTD., Suwon-Si (KR)

(72) Inventors: Dae Hui Jo, Suwon-Si (KR); Hye Won Jung, Suwon-Si (KR); Sa Yong Lee, Suwon-Si (KR)

(73) Assignee: SAMSUNG ELECTRO-MECHANICS CO., LTD., Suwon-si (KR)

( * ) Notice: Subject to any disclaimer, the term of this patent is extended or adjusted under 35 U.S.C. 154(b) by 765 days.

(21) Appl. No.: 16/029,346

(22) Filed: Jul. 6, 2018

(65) Prior Publication Data

US 2019/0122808 A1 Apr. 25, 2019

(30) Foreign Application Priority Data

Oct. 20, 2017 (KR) ..... 10-2017-0136476

(51) Int. Cl.
*H01F 5/00* (2006.01)
*H01F 27/28* (2006.01)
(Continued)

(52) U.S. Cl.
CPC ..... *H01F 27/2804* (2013.01); *H01F 17/0013* (2013.01); *H01F 17/02* (2013.01);
(Continued)

(58) Field of Classification Search
CPC ..... H01F 27/2804; H01F 27/292; H01F 2017/0073; H01F 2027/2809; H01F 17/0013; H01F 17/02
(Continued)

(56) References Cited

U.S. PATENT DOCUMENTS 7,355,516 B2 * 4/2008 Appalucci ..... B65D 81/3453 340/568.1
8,810,350 B2 * 8/2014 Seko ..... H01F 41/043 336/192
(Continued)

FOREIGN PATENT DOCUMENTS

CN 106252025 B * 10/2018 ..... H01F 17/0013
JP 2017-005104 A 1/2017
(Continued)

OTHER PUBLICATIONS

Office Action issued in corresponding Korean Patent Application No. 10-2017-0136476 dated Feb. 15, 2022, with English translation.

*Primary Examiner* — Elvin G Enad
*Assistant Examiner* — Joselito S. Baisa
(74) *Attorney, Agent, or Firm* — Morgan, Lewis & Bockius LLP

(57) ABSTRACT

A coil electronic component includes a body having a multilayer structure formed by stacking a plurality of sheets and external electrodes disposed on outer surfaces of the body. A coil pattern is printed on each of the plurality of sheets. The coil pattern includes a coil body and a corner pattern spaced apart from the coil pattern and coupled to the external electrodes. An inner edge of the second coil pattern facing the coil body is formed as a curved line or a linear line.

15 Claims, 7 Drawing Sheets

(51) Int. Cl.
*H01F 27/29* (2006.01)
*H01F 17/00* (2006.01)
*H01F 17/02* (2006.01)

(52) U.S. Cl.
CPC ... *H01F 27/292* (2013.01); *H01F 2017/0073* (2013.01); *H01F 2027/2809* (2013.01)

(58) Field of Classification Search
USPC ..... 336/200
See application file for complete search history.

(56) References Cited

U.S. PATENT DOCUMENTS 9,601,259 B2 * 3/2017 Ozawa ..... H01F 17/0013
9,865,388 B2 * 1/2018 Ishida ..... H01F 27/2804
9,911,529 B2 * 3/2018 Sasaki ..... H01F 17/0013
10,236,112 B2 * 3/2019 Jung ..... H01F 41/041
10,269,482 B2 * 4/2019 Yoneda ..... H01F 17/0013
10,366,820 B2 * 7/2019 Ishizaki ..... H01F 27/2804
10,475,569 B2 * 11/2019 Yatabe ..... H05K 3/3431
10,638,611 B2 * 4/2020 Nishikawa ..... H01F 27/292
10,847,301 B2 * 11/2020 Aoki ..... H01F 17/0013
10,957,478 B2 * 3/2021 Kido ..... H01F 27/2804
11,211,142 B2 * 12/2021 Shih ..... G11C 29/44
2013/0093556 A1 * 4/2013 Lim ..... H01F 17/0013 336/200
2014/0097927 A1 4/2014 Yamamoto et al.
2014/0333407 A1 * 11/2014 Otsubo ..... H01F 17/0013 336/200
2017/0018351 A1 1/2017 Yatabe et al.
2017/0103846 A1 * 4/2017 Yoneda ..... H01F 27/2804
2017/0103848 A1 * 4/2017 Yoneda ..... H01F 17/0013
2017/0110234 A1 * 4/2017 Nishikawa ..... H01F 17/0013
2017/0207018 A1 7/2017 Jung
2017/0256352 A1 * 9/2017 Kido ..... H01F 27/2804
2017/0287620 A1 * 10/2017 Miyoshi ..... H01F 17/0013
2017/0287622 A1 * 10/2017 Ishizaki ..... H01F 41/042
2020/0035405 A1 * 1/2020 Kido ..... H01F 17/0013
2020/0234873 A1 * 7/2020 Kato ..... H01F 17/0013

FOREIGN PATENT DOCUMENTS

JP 2017-022304 A 1/2017
JP 2017-092505 A 5/2017
JP 2017-157770 A 9/2017
KR 10-1999-0000614 A 6/1997
KR 10-1998-0067791 A 10/1998
KR 10-2014-0007959 A 1/2014
KR 10-2017-0086802 A 7/2017

* cited by examiner

COIL ELECTRONIC COMPONENT

CROSS-REFERENCE TO RELATED APPLICATION

This application claims benefit of priority to Korean Patent Application No. 10-2017-0136476 filed on Oct. 20, 2017 in the Korean Intellectual Property Office, the disclosure of which is incorporated herein by reference in its entirety.

TECHNICAL FIELD

The present disclosure relates to a coil electronic component and, more particularly, to a high frequency inductor.

BACKGROUND

Recently, as electronic products have become smaller, thinner, and lighter and have increasingly higher density due to personalization, electronic components installed therein have also become complicated and miniaturized.

Among passive electronic components, a high frequency inductor includes a thin film type inductor, a winding type inductor, and a multilayer type inductor, according to manufacturing methods. Such a thin film type inductor requires a large amount of time and incurs high costs due to a sequential stacking scheme using a dielectric material, and the like, while such a winding type inductor has limitations in manufacturing small devices. The multilayer type inductor is advantageous for manufacturing a very small device and ensures process stability through manufacturing, allowing for interlayer connections, utilizing a batch-stacking method.

Like any other passive electronic components, high frequency inductors require various electric properties such as inductance, a quality (Q) factor, resistance, and the like, and mechanical properties such as rigidity, or the like.

SUMMARY

An aspect of the present disclosure may provide a coil electronic component which includes high inductance (L) and low resistance (R), while having a small size.

According to an aspect of the present disclosure, a coil electronic component may include a body including a multilayer structure including outer sheets including outermost coil patterns and a plurality of inner sheets disposed between the outer sheets and including inner coil patterns, and including a first side surface and a second side surface opposing each other in a width direction, an upper surface and a lower surface opposing each other in a thickness direction, and a first end surface and a second end surface opposing each other in a length direction; a first external electrode extending from the lower surface to the first side surface and electrically connected to a coil body of one of the outermost coil patterns; and a second external electrode extending from the lower surface to the second side surface and electrically connected to a coil body of another of the outermost coil patterns. Each of the outermost coil patterns may include a coil body and a corner portion spaced apart from the coil body and exposed to the body. Each of the inner coil patterns may include a coil body and corner portions spaced apart from the coil body and exposed to the body. Each corner portion may have an inner edge facing the coil body, the inner edge having a curved shape or a linear shape.

BRIEF DESCRIPTION OF DRAWINGS

The above and other aspects, features and other advantages of the present disclosure will be more clearly understood from the following detailed description taken in conjunction with the accompanying drawings, in which.

DETAILED DESCRIPTION

Exemplary embodiments of the present disclosure will now be described in detail with reference to the accompanying drawings.

Hereinafter, a coil electronic component according to an exemplary embodiment in the present disclosure will be described but it is not necessarily limited thereto.

Figure 1:
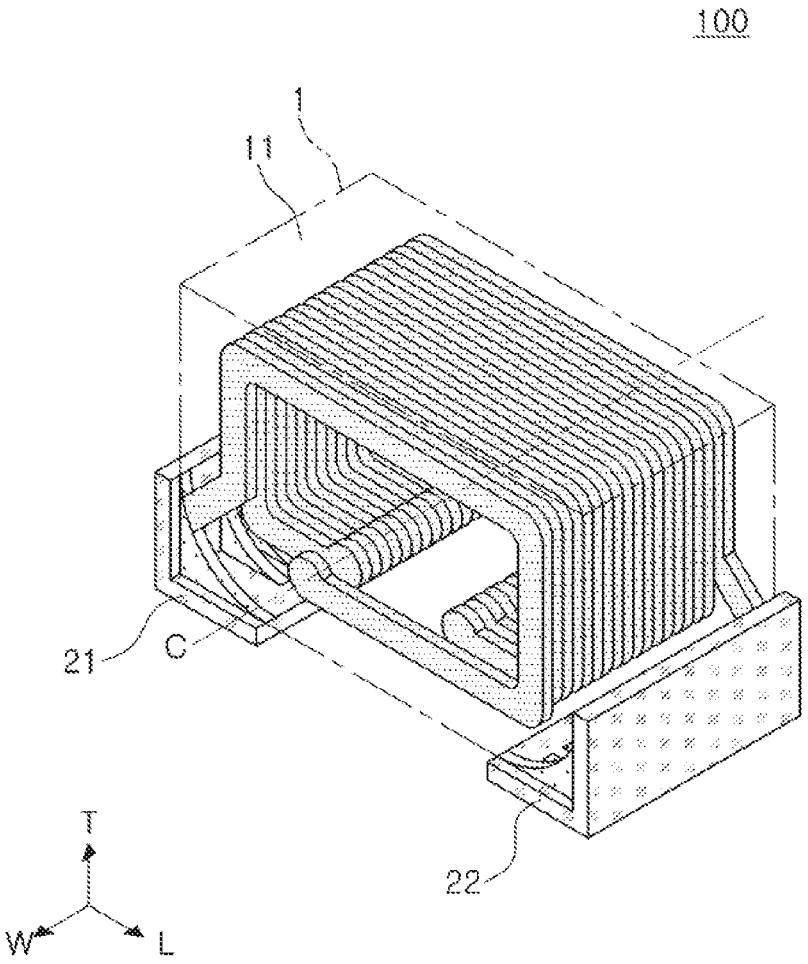
FIG. 1 is a schematic perspective view of a coil electronic component according to an exemplary embodiment in the present disclosure.
Figure 2:
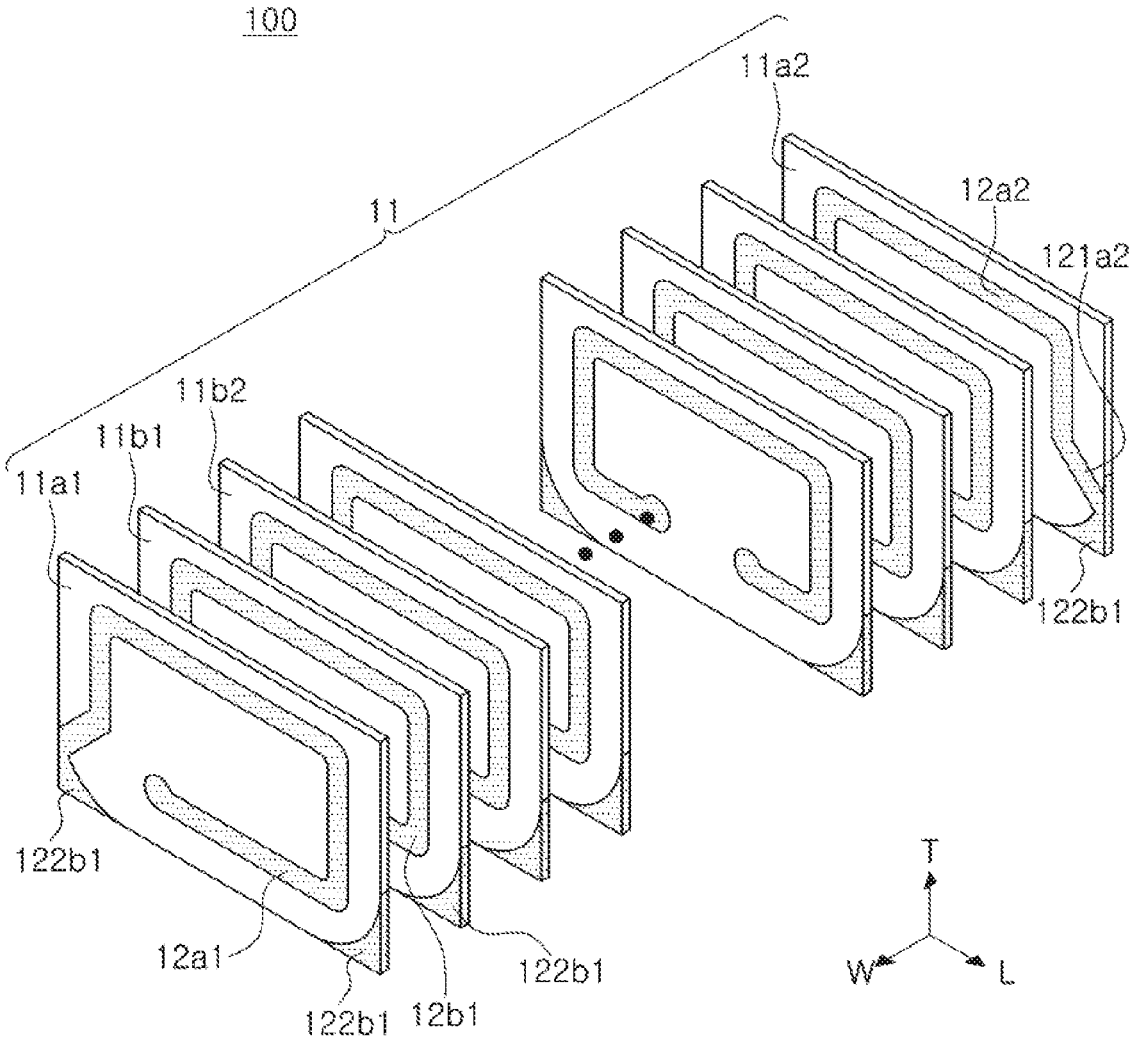
FIG. 2 is an exploded perspective view of a multilayer body in the coil electronic component of FIG. 1.

FIG. 1 is a schematic perspective view of a coil electronic component according to an exemplary embodiment in the present disclosure, and FIG. 2 is an exploded perspective view of a multilayer body in the coil electronic component of FIG. 1. The coil electronic component 100 may be, for example, a multilayered high frequency inductor.

Referring to FIGS. 1 and 2, the coil electronic component 100 includes a body 1 and external electrodes 21 and 22 on outer surfaces of the body 1.

The body 1 forms an appearance of the coil electronic component 100. The body 1 may have an upper surface and a lower surface opposing each other in a thickness direction T, a first end surface and a second end surface opposing each other in the length direction L, and a first side surface and a second side surface opposing each other in the width direction W. The body 1 may have a substantially hexahedral shape but is not limited thereto.

The body 1 has a multilayer structure 11 formed by stacking a plurality of sheets, and a stacking direction in which the plurality of sheets are stacked is the width W direction. Each of the plurality of sheets 11*a*1, 11*b*1, 11*b*2, . . . , 11*a*2 included in the multilayer structure 11 may be an insulating layer in the form of a thin film. The plurality of insulating layers forming the body 1 are in a sintered state and adjacent insulating layers may be integrated such that boundaries therebetween may not be readily apparent without using a scanning electron microscope (SEM).

The sheet is not limited and may include, for example, a known ferrite material or may be formed using a paste obtained by mixing ceramic powder and a resin. The resin may be, for example, polyvinyl butyral (PVB), ethyl cellulose (EC), or an acrylic resin, but, without being limited thereto, a thermosetting resin may also be employed.

Here, it may be sufficient for the sheet to have a thin film form and the sheet may have a thickness ranging from 10 μm to 50 μm, but may not need to be controlled to have a specific thickness. If the thickness of the sheet is less than 10 μm, it may be not be stable to print a coil pattern on the sheet, and if the thickness of the sheet is more than 50 μm, a problem of residues may frequently arise in the process of stacking a plurality of layers, forming a via hole, filling the via hole, and the like.

A coil pattern (or an electrically conductive pattern) is printed on each sheet. The coil patterns may be divided into an outermost coil pattern 12*a*1 directly connected to the first external electrode 21, an outermost coil pattern 12*a*2 directly connected to the second external electrode 22, and inner coil patterns 12*b*1, 12*b*2, . . . disposed between the outermost coil patterns. The outermost coil patterns 12*a*1 and 12*a*2 and the inner coil patterns 12*b*1, 12*b*2, . . . are connected through a via, constituting at least one coil having an overall spiral shape. A direction C of a core center of the coil is parallel to a direction in which the plurality of sheets are stacked.

The coil pattern is formed of a conductive metal layer having a predetermined thickness on the sheet. The coil pattern including corner portions if the coil pattern is an inner coil pattern, or the coil pattern including corner portions and an extending portion if the coil pattern is an outermost coil pattern, may be formed by printing a conductive paste. A material contained in the conductive paste is not limited as long as it is a metal having excellent electrical conductivity. For example, the material may include at least one of silver (Ag), palladium (Pd), aluminum (Al), copper (Cu), nickel (Ni), and the like.

The external electrodes 21 and 22 may be connected to the outermost coil patterns 12*a*1 and 12*a*2 so that the coil may be electrically conducted to an external electronic component. The external electrodes 21 and 22 may be disposed on the lower surface and the first end surface of the body 1 or on the lower surface and the second end surface of the body 1, having an overall L shape, but is not limited thereto.

For example, both the first and second external electrodes 21 and 22 may be disposed only on the lower surface of the body 1 to constitute bottom electrodes. In case where the first and second external electrodes are formed as bottom electrodes, loss of eddy current caused by the external electrodes formed on the first and second end surfaces and a self-resonant frequency (SRF) degradation of a high frequency inductor due to stray capacitance between the coil and the external electrodes may be prevented. However, in the case of the bottom electrodes, it is difficult to inspect mounting when the coil component is mounted on a printed circuit board (PCB), or the like, and coupling force between an internal coil and external electrodes is relatively weak.

Therefore, the first and second external electrodes 21 and 22 of the coil electronic component of FIG. 1 are formed to have the L-shape, instead of bottom electrodes, and here, since the L-shape may be deformed, it may be sufficient for the first and second external electrodes to extend from the lower surface onto at least one surface contiguous to the lower surface.

Figure 3:
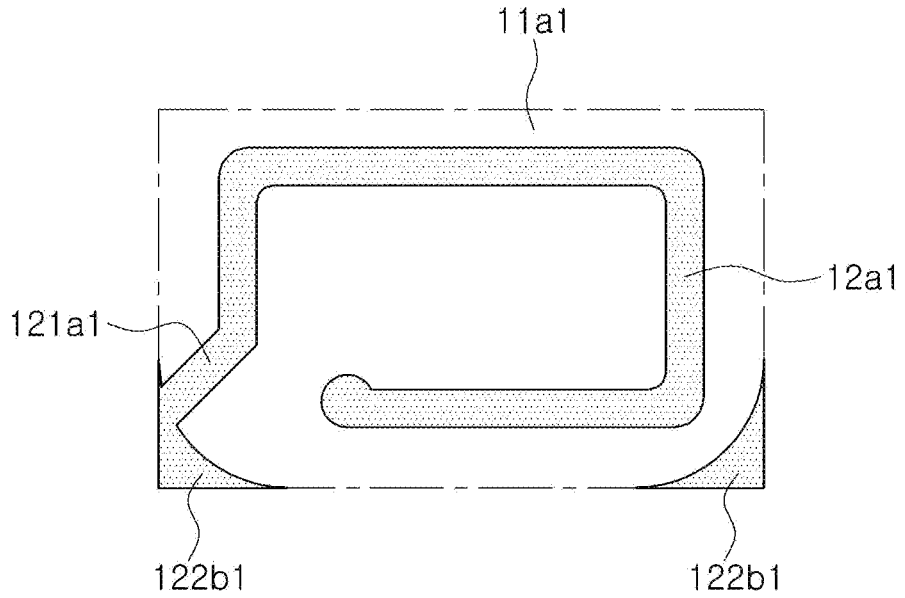
FIGS. 3 and 4 are cross-sectional views of outer sheets facing each other in a width direction and coil patterns formed thereon, respectively, in a body of the coil electronic component of FIG. 1.
Figure 4:
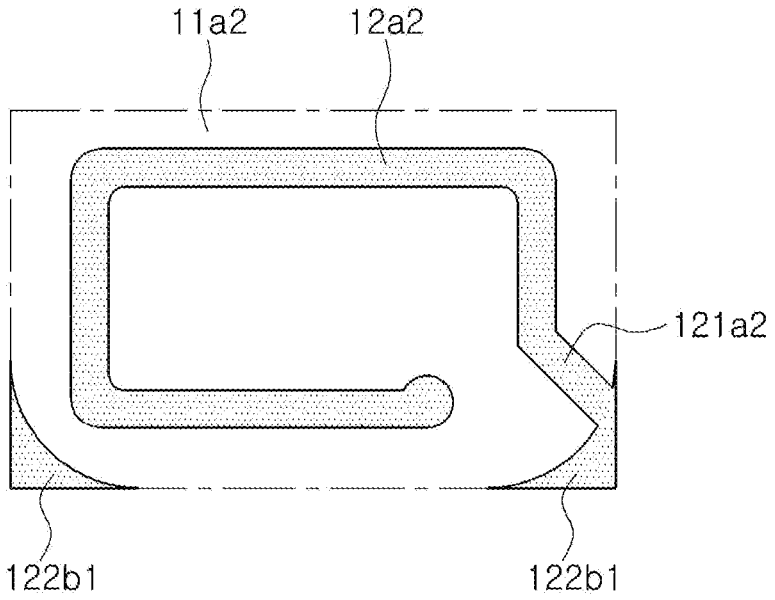

FIGS. 3 and 4 are cross-sectional views of the outer sheets 11*a*1 and 11*a*2 facing each other in the width direction and the outermost coil patterns 12*a*1 and 12*a*2 formed thereon in the body 1 of the coil electronic component 100 of FIG. 1, respectively. Referring to FIGS. 3 and 4, the outermost coil patterns 12*a*1 and 12*a*2 include extension portions 121*a*1 and 121*a*2 and corner portions 122*b*1 exposed to outer edges of the sheets, respectively. The extension portion 121*a*1 may connect one of the corner portions 122*b*1 and a coil body formed on the outer sheet 11*a*1 to each other, and the extension portion 121*a*2 may connect one of the corner portions 122*b*1 and a coil body formed on the outer sheet 11*a*2 to each other. The extension portion 121*a*1 and the corner portion 122*b*1 which the extension portion 121*a*1 is connected to may be a lead portion of the coil to electrically connect the coil to the first external electrode 21. The extension portion 121*a*2 and the corner portion 122*b*1 which the extension portion 121*a*2 is connected to may be a lead portion of the coil to electrically connect the coil to the second external electrode 22. A shape of the lead portions may be appropriately designed by a person skilled in the art, and as portions of the lead portions in contact with the external electrodes are longer, bonding force with the external electrodes may be increased. The corner portions 122*b*1 may have edges exposed to the body 1, such that the corner portions 122*b*1 may be in contact with a respective one of the first and second external electrodes 21 and 22.

In the outermost coil pattern 12*a*1, one of the corner portions 122*b*1 may be connected to the extension portion 121*a*1 and the other of the corner portions 122*b*1 may be spaced-apart from the remaining portion of the coil pattern 12*a*1. In the outermost coil pattern 12*a*2, one of the corner portions 122*b*1 may be connected to the extension portion 121*a*2 and the other of the corner portions 122*b*1 may be spaced-apart from the remaining portion of the coil pattern 12*a*2. By contrast, on a same inner sheet, both corner portions may be spaced apart from the remaining portion of an inner coil pattern (to be described hereinafter). This is because the first and second external electrodes 21 and 22 and the coil body may be electrically conducted through the lead portions 121*a*1 and 121*a*2 and the respective corner portions 122*b*1.

The outermost coil pattern and the inner coil pattern have the substantially same structure, except that whether the lead portion is present and that sectional areas of the patterns are different.

Figure 5:
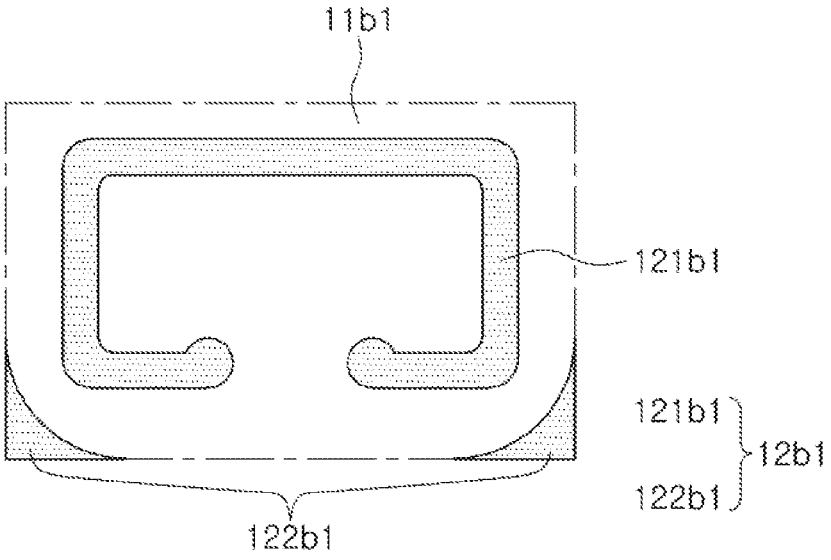
FIG. 5 is a cross-sectional view of an inner sheet except outer sheets in the body of the coil electronic component of FIG. 1 and a coil pattern formed thereon.

FIG. 5 is a cross-sectional view of an inner sheet excluding the outer sheets in the body of the coil electronic component of FIG. 1 and an inner coil pattern formed thereon.

Referring to FIG. 5, the inner coil pattern 12*b*1 printed on the inner sheet 11*b*1 includes a first coil pattern 121*b*1 and second coil patterns 122*b*1 (i.e., corner portions) spaced apart from the first coil pattern 121*b*1.

The first coil pattern 121*b*1 is for constituting a coil body, and as an area of the core center is increased, an inductance value may be increased. In this case, since an overall chip size of the coil electronic component cannot be increased infinitely, it is necessary to control the structure of the second coil patterns 122*b*1 printed on the same sheet on which the first coil pattern 121*b*1 is printed. Among edges of the second coil pattern 122*b*1 of FIG. 5, the edges facing the first coil pattern 121*b*1 are formed as curves having a predetermined curvature. Since one edge of the second coil pattern 122*b*1 is formed as a curve having a predetermined curvature, a large additional area which may occupied by the first coil pattern 121*b*1 may be secured in the same sheet. As a result, the area of the central portion of the first coil pattern 121*b*1 may be increased, realizing a high inductance value.

Meanwhile, even without changing the area of the central portion of the first coil pattern 121*b*1, electrical characteristics of a quality (Q) factor and Rs characteristics may be enhanced by controlling a shape of the second coil pattern 122*b*1 with respect to a determined area of the core center. In detail, Table 1 below shows that, in the case of the structure of the first and second coil patterns illustrated in FIG. 5, a line width of the first coil pattern 121*b*1 may be increased, and as a result, the Q factor may be improved and Rs is reduced. In the related art high frequency inductor, an inner edge of the second coil pattern has an L shape, rather than a curved portion. In this case, since a shortest distance between the first coil pattern and the second coil pattern is relatively short, there is a limitation in increasing a line width of the first coil pattern. However, referring to FIG. 5, since the portions of the second coil pattern facing the first coil pattern are curved, a shortest distance between the first and second coil patterns may be relatively sufficiently secured.

TABLE 1

| | Line width of first coil pattern | Characteristic @ 2.4 GHz | | Variation | |
|---|---|---|---|---|---|
| | | Q | Rs [Ω] | Q | Rs [Ω] |
| 0201 0.2T 10.0 nH | 5 μm | 24.3 | 6.5 | 0.0% | 0.0% |
| | 8 μm | 26.7 | 5.6 | 9.9% | −13.8% |
| 0.02 0.2T 4.7 nH | 4.8 μm | 27.6 | 3.1 | 0.0% | 0.0% |
| | 12 μm | 30.8 | 2.3 | 13.2% | −12.3% |

Meanwhile, a degree of concaveness of the inner edge of the second coil pattern may be appropriately designed by a person skilled in the art. A radius of curvature X of the inner edge of the second coil pattern may be adjusted within a range of 100% to 1000% of a longest edge Y of the other edges of the second coil pattern. If the radius of curvature is smaller than 100% of the length of the other edges of the second coil pattern, physical adhesion between the second coil pattern and the external electrode may not be sufficiently secured, and if it is larger than 1000%, there may be a limitation in controlling process facilities.

Further, edges other than the inner edge of the second coil pattern may be adjusted within a range of 20 μm or more and 150 μm or less. Since the length of the edge of the second coil pattern must be determined in consideration of the overall size of the sheet on which the second coil pattern (or the corner portion) is printed, a numerical range of the length of the edge limits an appropriate length of the edge which may be derived when the recently required chip size is taken into consideration. In this case, the length of the exterior edge of the second coil pattern may be appropriately set, but the length of the exterior edge extending in the thickness direction of the body or the length of the exterior edge extending in the length direction of the body may be shorter than a length of the external electrode in contact therewith and extending in the thickness direction or the length direction of the body. If the length of the exterior edge of the second coil pattern is longer than the external electrode so the external electrode cannot entirely cover the corner of the second coil pattern, reliability of a product may be problematic.

Figure 6:
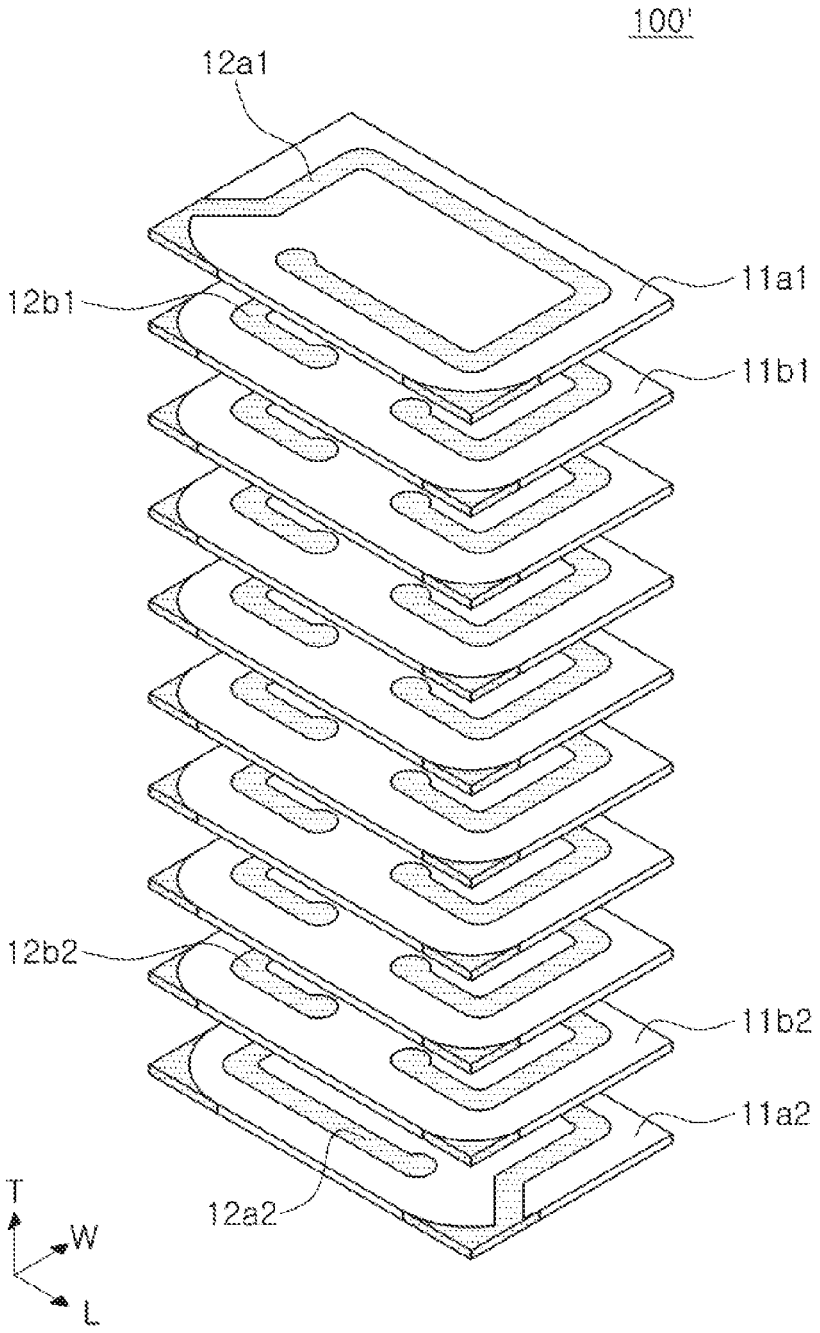
FIG. 6 is a schematic exploded perspective view according to a modification of FIG. 2.

FIG. 6 is an exploded perspective view of a multilayer structure according to a modification 100' of the exploded perspective view of FIG. 2. Referring to FIG. 5, it can be seen that the area of the second coil pattern (or the corner portion) on the inner sheet is less than the area of the second coil pattern (or the corner portion) on the outer sheet. This is because, the second coil pattern on the outer sheet is required to be bonded more reliability when the external electrodes and the coil pattern are connected to each other, and thus, the second coil pattern has a relatively large area. As a result, adhesion between the external electrode and the internal coil is strengthened, enhancing overall rigidity of the chip. Meanwhile, the area of the second coil pattern on the inner sheet may be relatively small, increasing a possibility of ensuring high inductance, and since a gap between the corner portions that are electrically connected to the external electrode and the internal coil is widened, parasitic capacitance is reduced to improve the Q factor.

Figure 7:
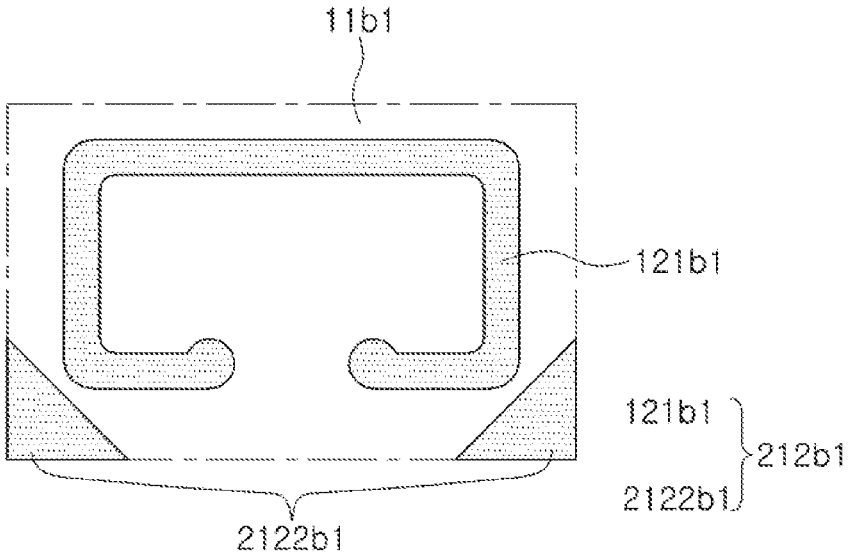
FIG. 7 is a cross-sectional view according to a modification of FIG. 5.
Figure 8:
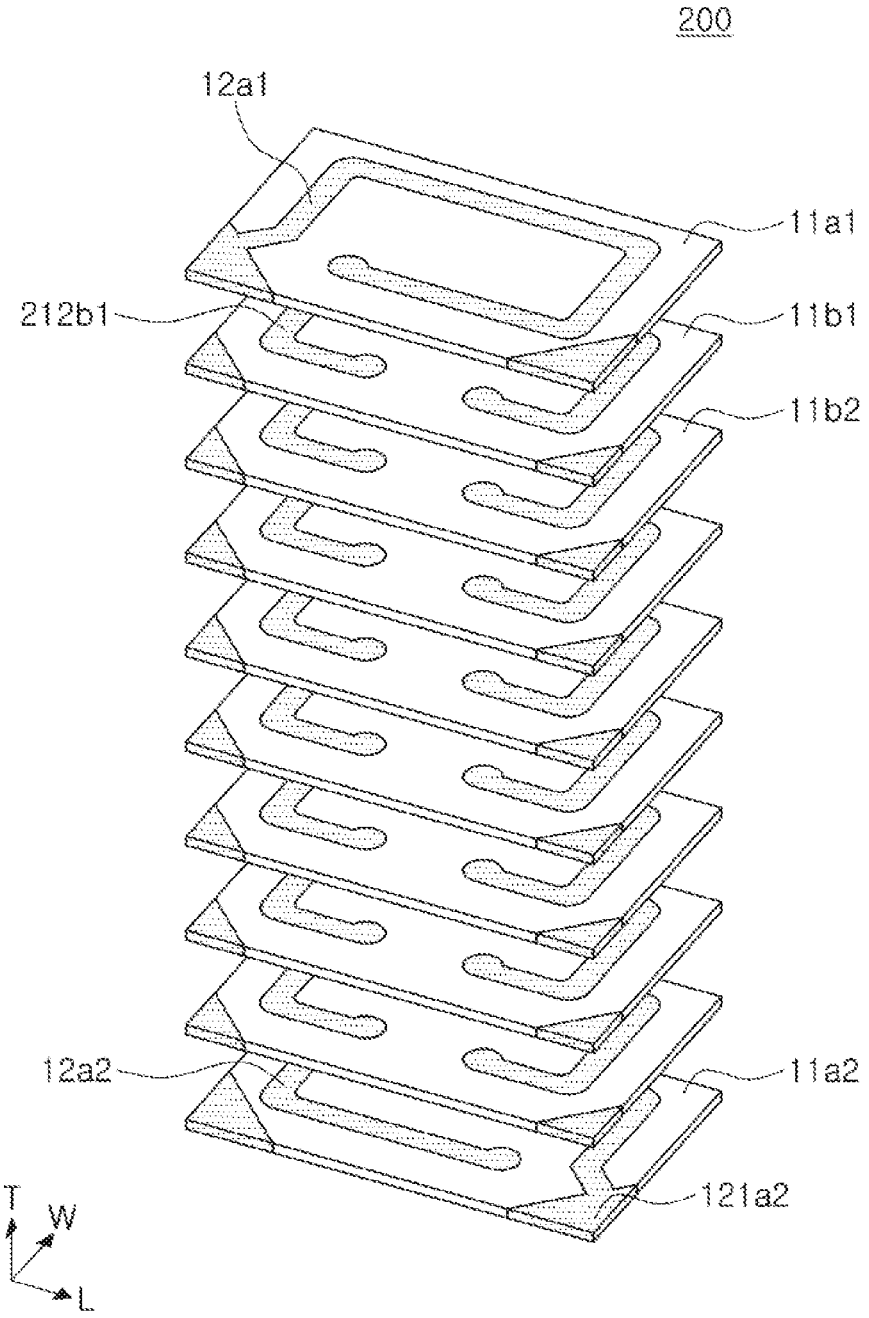
FIG. 8 is a schematic exploded perspective view according to another modification of FIG. 2.

Next, FIG. 7 is a cross-sectional view according to a modification of FIG. 5, and FIG. 8 is a schematic exploded perspective view according to another modification of FIG. 2.

FIGS. 7 and 8 illustrate a coil electronic component 200 which is different in a specific shape of the second coil pattern (i.e., the corner portion) as compared with the coil electronic component 100 described above. For the purposes of description, the same description of the coil electronic component 200 illustrated in FIGS. 7 and 8 as that of the coil electronic component 100 illustrated in FIGS. 1 through 5 will be omitted, and the same reference numerals will be used for the same components.

Referring to FIGS. 7 and 8, in an inner coil pattern 212*b*1, the inner edges in which the second coil patterns 2122*b*1 (or the corner portions) face the first coil patterns 121*b*1 (or coil body) on the plurality of sheets are formed to be linear. As a result, a cross-section with respect to the L-T surface of the second coil pattern has a triangular shape.

When the second coil pattern 2212*b*1 is formed as a triangle, a shortest distance between the first and second coil patterns may be increased and the area of the internal core formed by the first coil pattern may be sufficiently secured, as compared with the related art high frequency inductor in which the second coil pattern has an L shape. As a result, parasitic capacitance of the coil electronic component may be reduced to improve the Q factor and the possibility of increasing the inductance value may also be increased.

Referring to FIG. 8, since the sectional area of the second coil patterns (or the corner portions) of the outer sheets 11*a*1 and 11*a*2 is larger than the sectional area of the second coil patterns (or the corner portions) of the inner sheets 11*b*1, 11*b*2 as described above with reference to FIG. 6, parasitic capacitance may be reduced, while sufficient bonding strength between the external electrode and the internal coil is ensured.

When the above-described coil electronic components 100 and 200 are used, a high frequency inductor having excellent electrical properties of inductance, Q value, R value and excellent mechanical properties relating to bonding between the external electrodes and the coil may be provided. By changing the shape of the second coil pattern in direct contact with the external electrodes, a sufficient electrode distance may be secured to reduce the R value and a room for increasing the inner area of the first coil pattern forming the coil body may be secured to realize inductance of high capacity. Further, by relatively increasing the area of the second coil pattern which is physically in direct contact with the external electrode in the outer sheet among the plurality of sheets, mechanical strength of the chip may be sufficiently ensured.

As set forth above, according to exemplary embodiments of the present disclosure, the high-frequency inductor having both electromagnetic characteristics of high inductance and a reduced resistance value and mechanical characteristics of mechanical rigidity, as required electromagnetic and mechanical characteristics, may be provided.

While exemplary embodiments have been shown and described above, it will be apparent to those skilled in the art that modifications and variations could be made without departing from the scope of the present invention as defined by the appended claims.

What is claimed is:

1. A coil electronic component comprising:

a body including a multilayer structure including outer sheets including outermost coil patterns and a plurality of inner sheets disposed between the outer sheets and including inner coil patterns, and including a first side surface and a second side surface opposing each other in a width direction, an upper surface and a lower surface opposing each other in a thickness direction, and a first end surface and a second end surface opposing each other in a length direction;

a first external electrode extending from the lower surface to the first end surface and electrically connected to a coil body of one of the outermost coil patterns; and a second external electrode extending from the lower surface to the second end surface and electrically connected to a coil body of another of the outermost coil patterns, wherein each of the outermost coil patterns includes a coil body and a corner portion physically isolated from the coil body, each of the inner coil patterns includes a coil body and corner portions physically isolated from the coil body, each corner portion has an inner edge facing the coil body, the inner edge having a curved shape or a linear shape connecting the lower surface to the first end surface or the second end surface, and a sectional area of the corner portions disposed on the outer sheets, is larger than a sectional area of the corner portions disposed on the plurality of inner sheets.

2. The coil electronic component of claim 1, wherein the outer sheets and the plurality of inner sheets are stacked in the width direction.

3. The coil electronic component of claim 1, wherein each of the first and second external electrodes does not extend to the upper surface, the first side surface, and the second side surface.

4. The coil electronic component of claim 1, wherein the corner portion has a triangular cross-sectional shape with respect to a length-thickness direction.

5. The coil electronic component of claim 4, wherein on a same outer sheet or on a same inner sheet, a minimum distance between the coil body and the corner portion is a distance from the coil body to a center of an inner edge of the corner portion.

6. The coil electronic component of claim 1, wherein the inner edge of the corner portion is a concave curved line.

7. The coil electronic component of claim 6, wherein a radius of curvature of the inner edge of the corner portion ranges from 100% to 1000% of a length of a longest edge among all of the edges of the corner portion.

8. The coil electronic component of claim 1, wherein a length of exterior edges of the corner portion exposed to the body ranges from 20 μm to 150 μm.

9. The coil electronic component of claim 1, wherein each of the plurality of inner sheets and the outer sheets includes a thermosetting resin.

10. The coil electronic component of claim 9, wherein a thickness of each of the plurality of sheets and the outer sheets ranges from 10 μm to 50 μm.

11. The coil electronic component of claim 1, wherein each of the outer sheets includes another corner portion connected to one of the first and second external electrodes and physically contacting with an extension portion electrically connected to the coil body disposed on the same outer sheet.

12. The coil electronic component of claim 11, wherein the extension portions of the outer sheets extend in directions toward the first and second external electrodes, respectively.

13. The coil electronic component of claim 1, wherein points to which the corner portions extend in the thickness direction of the body are lower than points to which the first and second external electrodes extend on the first end surface and the second end surface of the body in the thickness direction of the body.

14. The coil electronic component of claim 1, wherein the coil bodies are connected to each other to form an internal coil having an overall spiral shape.

15. The coil electronic component of claim 14, wherein a direction of a core center of the internal coil is parallel to a direction in which the plurality of inner sheets and the outer sheets are stacked.

* * * * *